US009004798B1

(12) United States Patent
Schumaier

(10) Patent No.: US 9,004,798 B1
(45) Date of Patent: Apr. 14, 2015

(54) GOLF TEE INSERTION DEPTH MEASUREMENT TOOL

(71) Applicant: Daniel R Schumaier, Elizabethton, TN (US)

(72) Inventor: Daniel R Schumaier, Elizabethton, TN (US)

(73) Assignee: TeeCorrect, LLC, Johnson City, TN (US)

( * ) Notice: Subject to any disclaimer, the term of this patent is extended or adjusted under 35 U.S.C. 154(b) by 0 days.

(21) Appl. No.: 14/246,326

(22) Filed: Apr. 7, 2014

Related U.S. Application Data

(63) Continuation-in-part of application No. 14/035,523, filed on Sep. 24, 2013.

(51) Int. Cl.
*B43K 29/00* (2006.01)
*A63B 57/00* (2006.01)
*B25H 7/04* (2006.01)

(52) U.S. Cl.
CPC ..... *A63B 57/0018* (2013.01); *B25H 7/04* (2013.01)

(58) Field of Classification Search
USPC ..... 401/266; 33/485, 666; 473/386, 387
See application file for complete search history.

(56) References Cited

U.S. PATENT DOCUMENTS

| | | | | |
|---|---|---|---|---|
| 3,480,371 | A | 11/1969 | Lee | |
| 3,858,878 | A * | 1/1975 | Tassone | 473/417 |
| 4,982,510 | A | 1/1991 | Musillo | |
| 5,242,161 | A * | 9/1993 | Wilkirson | 473/386 |
| 5,356,146 | A | 10/1994 | Blosser | |
| 5,728,012 | A | 3/1998 | Boelling | |
| 5,735,758 | A | 4/1998 | Miketinac | |
| 6,482,111 | B1 | 11/2002 | Jofferion | |
| 6,932,722 | B2 | 8/2005 | Wood | |
| 7,037,218 | B2 * | 5/2006 | Lubosco et al. | 473/387 |
| 7,044,866 | B1 | 5/2006 | Blauvelt | |
| 7,223,184 | B2 | 5/2007 | Suwito | |
| 7,458,906 | B2 * | 12/2008 | Choe | 473/387 |
| 7,717,811 | B1 * | 5/2010 | Merullo | 473/387 |
| 7,841,096 | B1 | 11/2010 | Jenkins | |
| D653,721 | S | 2/2012 | Jenkins | |
| D676,918 | S | 2/2013 | Jenkins | |
| 2004/0152542 | A1 | 8/2004 | Blum et al. | |
| 2005/0070379 | A1 * | 3/2005 | Gilmour | 473/400 |
| 2005/0233838 | A1 | 10/2005 | Kahl | |
| 2007/0042839 | A1 * | 2/2007 | Smith et al. | 473/386 |

(Continued)

OTHER PUBLICATIONS

Design Improvised Father's Day Craft, published on http://www.designimprovised.com, Jun. 12, 2013.
The Exact Tee™ found on http://www.exact-tee.us.com, published as early as 2012.
Smart-Tee adjustable golf tees and custom golf tees found on http://www.smartgolftee.com, published as early as 2013.

(Continued)

*Primary Examiner* — David Walczak
*Assistant Examiner* — Jennifer C Chiang
(74) *Attorney, Agent, or Firm* — Luedeka Neely Group, P.C.

(57) ABSTRACT

A golf tee insertion depth measurement tool provides a gauge to facilitate marking the shaft of a golf tee to indicate a desired insertion depth that provides an optimum height for a golf ball placed on the tee, which ball is to be struck by a club face having a height H. The tool has a base portion and an elongate stem portion having a stem length. The base portion has a first surface and a second surface. The stem portion is connected to the base portion and extends outwardly away from the second surface of the base portion. The stem portion is first marked along its length at a location corresponding to the club face height H above the ground. The shaft of a tee is then marked at a location corresponding to the marked location on the stem portion to provide the correct insertion depth for the tee.

3 Claims, 8 Drawing Sheets

(56) References Cited

U.S. PATENT DOCUMENTS

| | | | | |
|---|---|---|---|---|
| 2007/0266584 | A1 | 11/2007 | Munson | |
| 2013/0150187 | A1 * | 6/2013 | Hanley | 473/386 |
| 2014/0031146 | A1 | 1/2014 | Kelley | |

OTHER PUBLICATIONS

Pride professional tee system found on http://www.golftees.com, published as early as 2007.

Tee height setters, golf forum found on http://www.thesandtrap.com, as early as May 9, 2012.

* cited by examiner

GOLF TEE INSERTION DEPTH MEASUREMENT TOOL

FIELD

This invention relates to gauges for golf tees and, in particular, to a golf tee insertion depth measurement tool that provides a gauge to facilitate marking the shaft of a golf tee at a certain height to assist in ensuring that the golf tee is inserted into the ground at the desired depth consistently.

BACKGROUND

In general, a golf tee is preferably set at a height such that the horizontal center of the golf ball is located approximately at the same height as the upper edge of the striking face of the club when the club is resting on the ground. Different clubs are sized differently and so the golf tee and ball must be raised or lowered accordingly. Additionally, maintaining a constant golf ball height from one hole to the next is an important factor in maintaining a consistent swing path.

What is needed, therefore, is a golf tee insertion depth marker that facilitates the process of quickly and consistently identifying an appropriate insertion depth wherein the horizontal center of the golf ball is located approximately at the same height as the upper edge of the striking face of the club to assist the golfer in maintaining a consistent tee height from one shot to the next.

SUMMARY

The above and other needs are met by a golf tee insertion depth measurement tool for facilitating marking the shaft of a golf tee at a certain height to assist in ensuring that the golf tee is inserted into the ground at the desired depth consistently.

In one embodiment, the measurement tool comprises a base portion and an elongate stem portion having a stem length. The base portion has a first surface that is substantially planar and a second surface spaced apart from the first surface by a first distance D. The stem portion is connected to the base portion and extends outwardly away from the second surface of the base portion. In certain embodiments, the stem length is greater than the height H of the clubface. In other embodiments, the stem length is from approximately 2¾ inches to approximately 4 inches in length. In certain embodiments, D is substantially equivalent to the radius of the golf ball. In other embodiments, D is approximately 0.84 inches. The elongate stem portion may be disposed orthogonally to the first surface of the base portion. With this configuration, the stem portion extends vertically upward when the tool is placed on a flat ground surface. In certain embodiments, the base portion is semicircular. In other embodiments, the base portion forms a hemisphere. In still other embodiments, the base portion forms a half hemisphere. The base portion may include a plurality of grip features, which facilitate gripping and manipulating the tool.

In some embodiments, the stem portion is pre-marked with horizontal lines, numbers, or other indicator markings that correspond to the heights of the striking faces of various sizes of drivers and other golf clubs. These indicator markings may be of different colors.

In another aspect, a preferred embodiment provides a method of using a golf tee insertion depth measurement tool to mark a shaft of a golf tee to indicate a desired insertion depth. When the tee is inserted at the desired depth, a golf ball will be at an optimum height when placed on the tee, which ball is to be struck by a club face having a height H. The method includes the steps of (a) providing a golf tee insertion depth measurement tool, such as the tool described above, (b) providing a golf tee having a head, a shaft and a tip, (c) placing the first surface of the base portion of the measurement tool on the ground surface, (d) placing the golf club head on the ground surface with the striking face of the golf club adjacent the measurement tool, (e) marking the stem portion of the measurement tool at a first location that is at a height above the ground surface equivalent to the height of the upper edge of the striking face of the golf club above the ground surface, and (f) marking the shaft of the golf tee at a location that is aligned with the mark made at the first location on the stem portion of the measurement tool.

In an alternative method that involves use of the measurement tool that is pre-marked with the indicator markings, instead of marking the stem portion at the desired height (step (e)), the golfer takes note of which of the indicator markings is most closely aligned with the height of the upper edge of the striking face of the golf club. The tee is then marked at a location aligned with that indicator marking.

In certain embodiments, the method may further include the step of placing the head of the golf tee adjacent the second surface of the base portion so that the shaft of the tee extends along the stem portion to facilitate marking the shaft of the golf tee and transferring the location marked on the tool directly to an equivalent location on the shaft of the tee.

In other embodiments, the method may include the step of (a) providing a golf tee insertion depth marking device for marking the shaft of the golf tee. The device includes a housing having a first surface and a second surface, and a plurality of bores extending from the first surface into the housing. Each bore has a depth that is different from depths of other of the bores, and a diameter sufficient to receive the shaft of the golf tee when the shaft is inserted therein. The device includes a plurality of windows disposed in the second surface of the housing, each of which provides an opening into a corresponding one of the bores. Each window is of sufficient size to receive a tip portion of a marking pen inserted therein, whereby the tip portion of the marking pen makes contact with and marks the shaft of the golf tee inserted into one of the bores. The method includes the steps of (b) inserting the marked stem portion of the measurement tool into at least one of the bores to determine an appropriate well in which the mark on the stem portion is visible through the opening, (c) removing the stem portion from the appropriate well, (d) inserting the golf tee into the appropriate well, and (e) marking the shaft of the golf tee by inserting the tip portion of a marking pen into the window of the appropriate well and contacting the shaft of the golf tee.

Further details of each of these and other embodiments of the invention are provided in the drawings and in the detailed description.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1A:
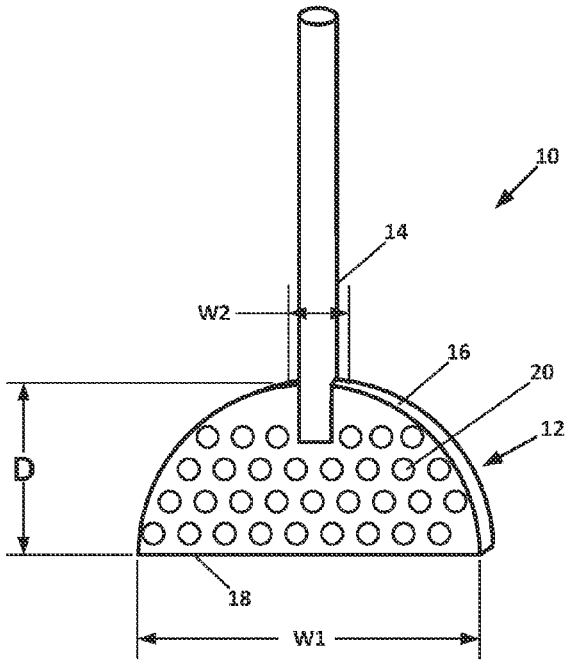
FIGS. 1A, 1B and 1C depict golf tee insertion depth measurement tools according to a first embodiment of the invention.
Figure 1B:
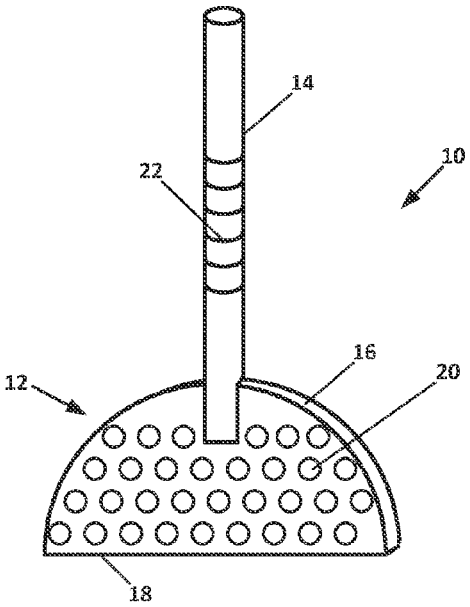
Figure 1C:
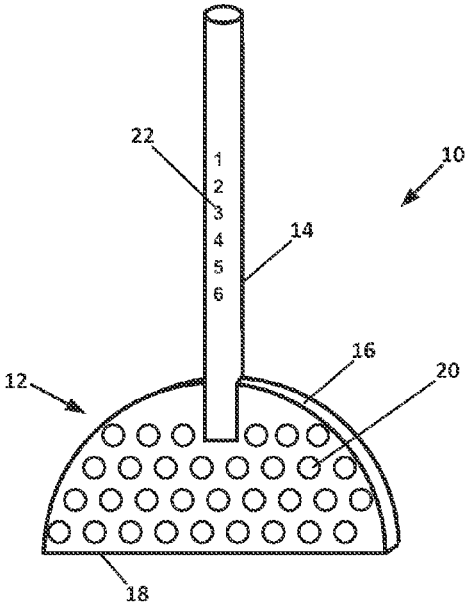

Turning now to the drawings in greater detail and considering first FIGS. 1A-1C, there is illustrated an embodiment, generally indicated 10, of a golf tee insertion depth measurement tool.

The tool 10 includes a unitary body generally having a base portion 12 and an elongate stem portion 14 that extends outwards away from the base portion. In this embodiment, the base portion 12 resembles a golf ball that has been cut in half along a horizontal line with a rounded edge 16 and a flat edge 18. The stem portion 14 extends downward from the center of the rounded edge 16. The diameter of the stem portion 14 is the same or approximately the same as the diameter of the shaft portion of a traditional golf tee. The length of the stem portion 14 may vary in various embodiments, but generally approximates the length of standard golf tees, some of which are around 3 inches in length. In certain embodiments, the stem portion 14 is longer than the height of the club face of the selected club. In other embodiments, the stem portion 14 may be from approximately 2¾ inches to approximately 4 inches in length to be used with golf tees having corresponding lengths.

The base portion 12 is sized such that the distance between the rounded edge 16 and the flat edge 18 is approximately the radius of a golf ball. For today's standard golf balls, that distance is approximately 0.84 inches. The base portion 12 may be formed as a generally flat plate as shown in FIGS. 1A-1C or, in other embodiments, a portion may be more three dimensional in shape. For example, the base portion 12 may resemble a hemisphere or half a hemisphere. An advantage of a more three dimensional in shape is the possibility of added rigidity and stability. An advantage of having a thinner, more plate-like configuration is that the tool 10 would be smaller and easier to carry and store. Additionally, placing the tool 10 in close approximation to the face of a golf club would be simpler with a more plate like base portion. The base portion 12 may optionally include grip features 20, such as ridges, dimples, notches, knobs or the like, which assist in gripping and handling the tool 10.

Figure 2:
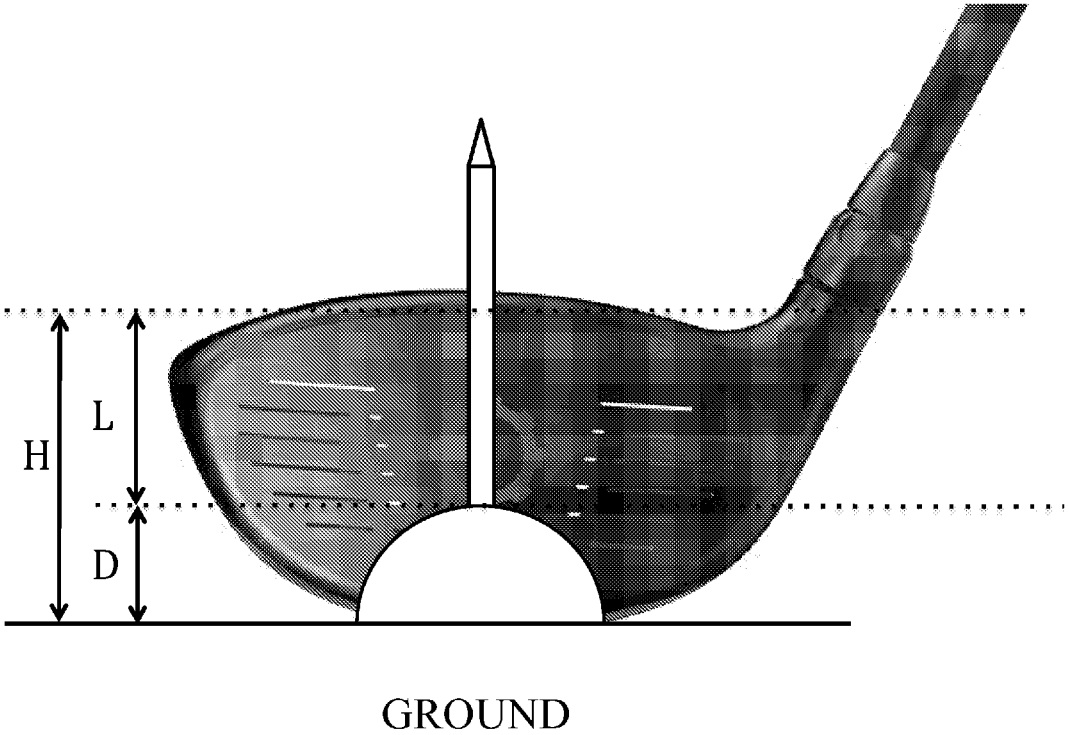
FIG. 2 depicts a front elevation view of a golf tee insertion depth measurement tool positioned adjacent the striking face of a golf club, and illustrates a height H that represents the optimum distance from the ground to the horizontal centerline of the ball when the ball is set on a tee.
Figure 3:
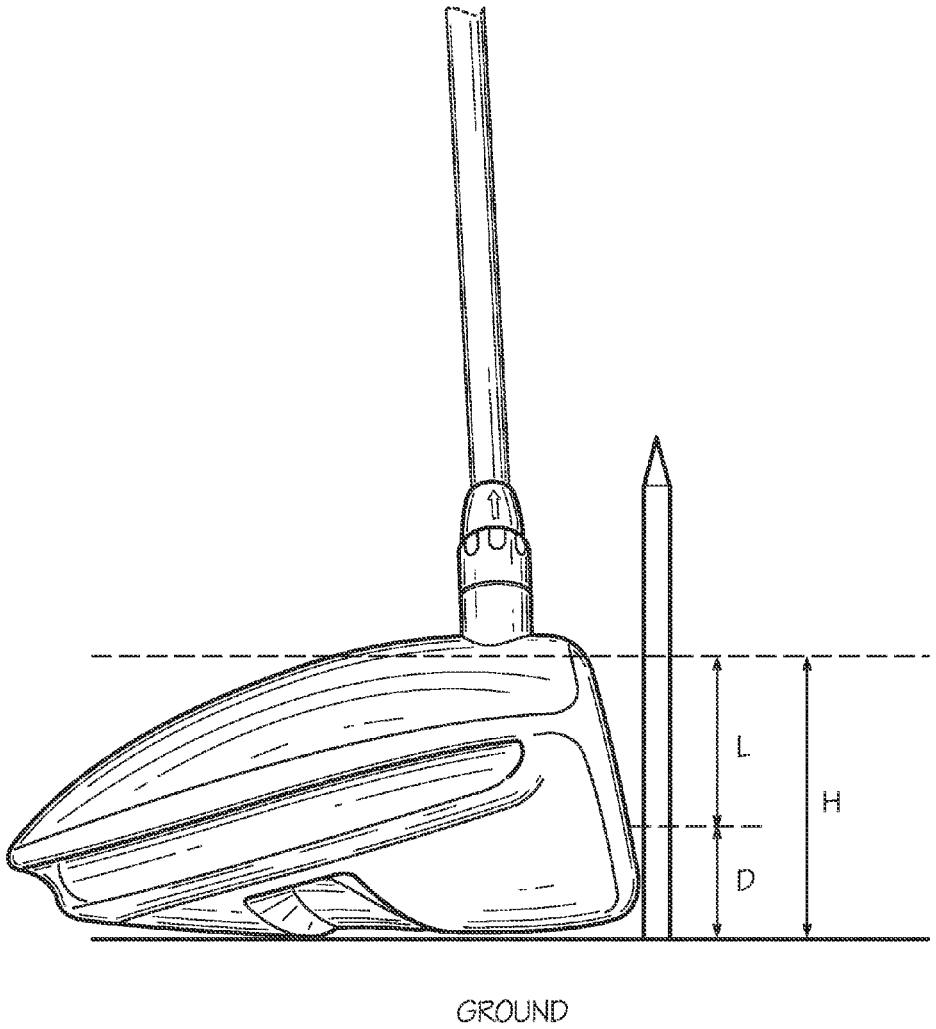
FIG. 3 depicts a side elevation view of the golf tee insertion depth measurement tool and golf club shown in FIG. 2.
Figure 4:
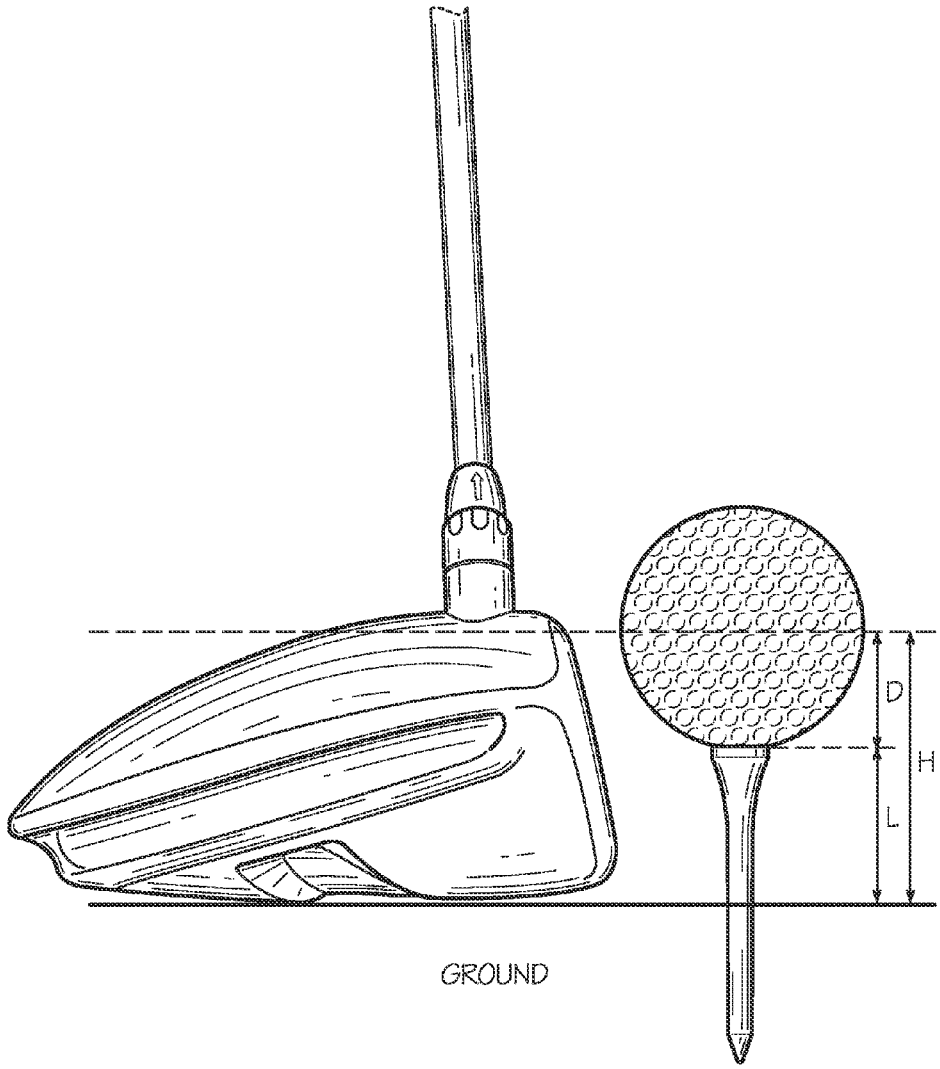
FIG. 4 depicts a side elevation view of a golf tee and golf ball where the horizontal centerline of the golf ball is H distance from the ground.
Figure 6:
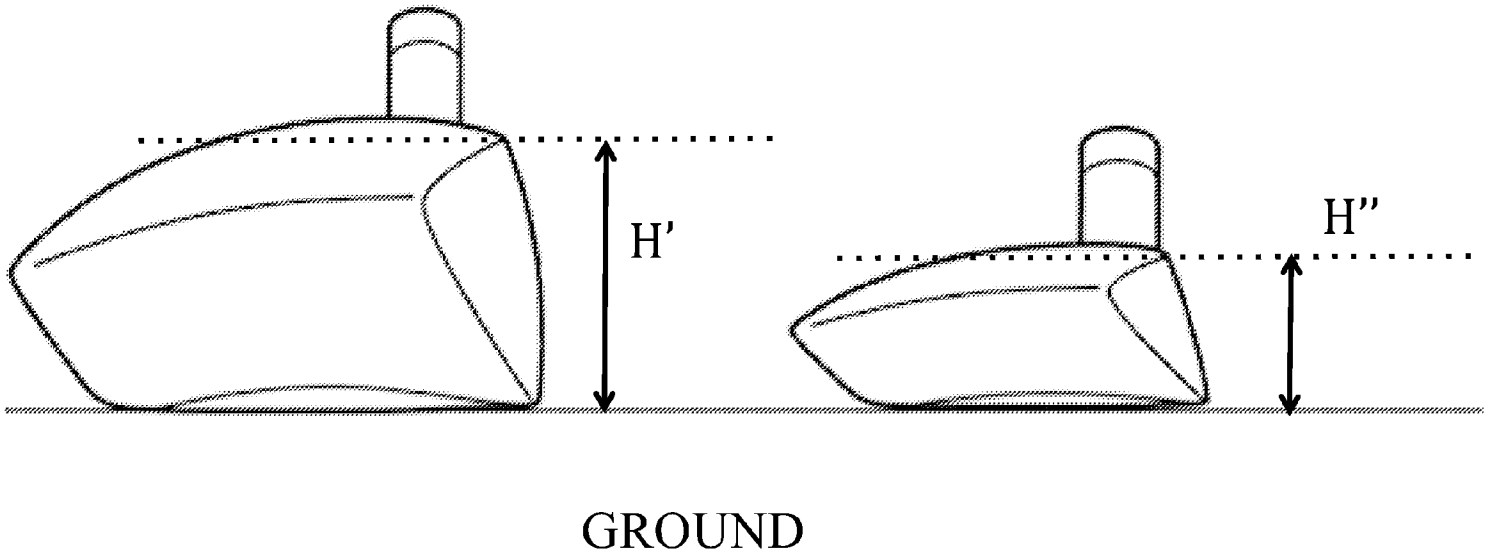
FIG. 6 illustrates various club heads having different sized striking faces and corresponding heights H' and H"

In general, the tool 10 may be used to determine the appropriate distance that a tee should be inserted into the ground such that, once a ball is placed on the tee, it is located at the ideal vertical height above the ground. With reference to FIGS. 2-4, the distance H represents the distance from the ground surface to the top of the striking face of the golf club. As explained above, ideally, the horizontal centerline of the golf ball should be located at a distance H from the ground surface. As such, one half the height of the golf ball (i.e., the radius of the golf ball) plus the portion of the golf tee above the ground surface should equal the distance H. The distance H will vary according to the type and size of club that is used. For example, as shown in FIG. 6, a first club (e.g., 1-wood) may have a first height H' whereas a second club (e.g., a 5-wood) may have a second height H".

It may be difficult to repeatedly and consistently estimate the horizontal centerline of a golf ball. As such, the tool 10 is provided with a base portion 12 that approximates the radius of a standard golf ball. As shown in FIG. 1A, a distance D between the flat edge 18 and the rounded edge 16 measured orthogonally from the center of the flat edge 18 equals approximately the radius of a standard size golf ball. As such, to properly locate the golf ball above the ground surface, the tee should be inserted into the ground until a distance L, equal to H minus D, extends above the ground surface.

In use, the tool 10 is first placed onto a ground surface where the tee is to be located such that the flat edge 18 of the base portion 12 rests on the ground surface. The golf club is then placed in close approximation to the tool 10. It may be appreciated that obtaining an accurate measurement of vertical height is important to obtaining a ball located at the ideal height. An advantage of the flat edge 18 is that it ensures the stem portion 12 points vertically and is not tilted from side to side, thereby ensuring that the vertical measurement taken is accurate. To ensure that the tool 10 does not lean forward or backward, some embodiments of the tool 10 may be provided with a more three dimensional (i.e., non-flat) base portion, such as a hemispherical base portion, to ensure the tool remains vertical in the forward and backward directions as well.

Figure 5:
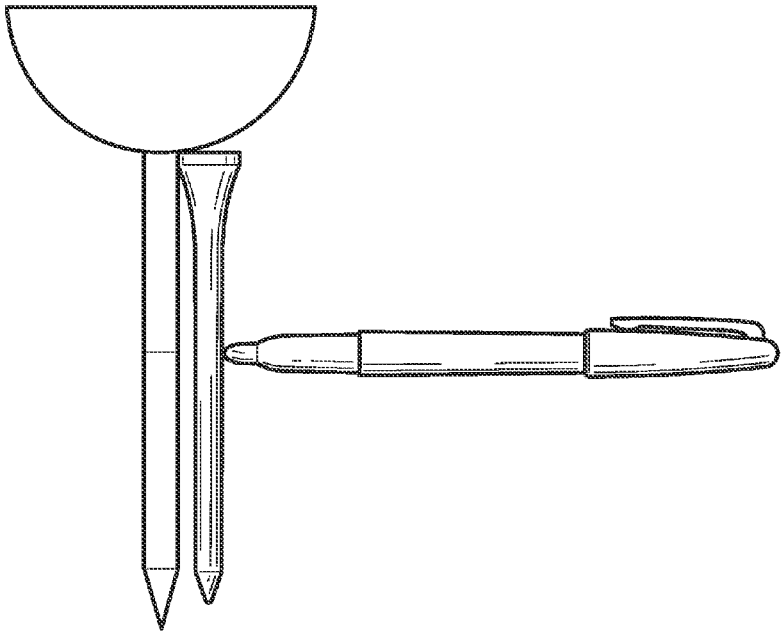
FIG. 5 depicts an elevation view of a measurement tool that has been marked at a location along the stem portion and a golf tee to be marked at an equivalent location along its shaft.

Next, the stem portion 14 is marked at a distance H. With reference to FIG. 5, that marking may then be transferred to one or more tees by aligning the head of the tee (i.e., the portion of the tee where the ball sits) with the rounded edge 16 of the tool 10 and then marking the tee at the same location as the marking on the stem portion 14. Once marked at the appropriate location, the same tool 10 may be used repeatedly to mark additional tees as needed for the selected club.

Alternatively, instead of transferring the marked location from the tool 10 directly to the tee, the marked tool 10 may be used in conjunction with a golf tee insertion depth marking device to locate and provide markings on golf tees at the appropriate locations. An example of one such golf tee insertion depth marking device is described in U.S. patent application Ser. No. 14/171,032, filed Feb. 3, 2014, entitled "Golf Tee Insertion Depth Marker," which is incorporated herein by reference in its entirety.

Figure 9A:
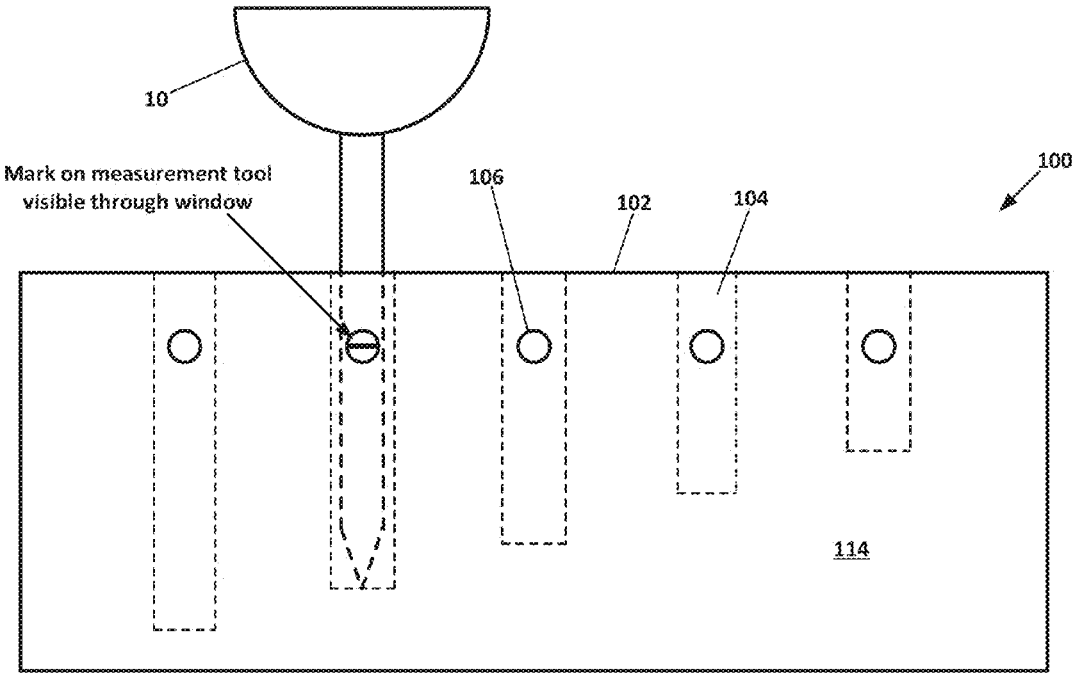
FIG. 9A illustrates a golf tee insertion depth measurement tool inserted into a golf tee insertion depth marking tool.
Figure 9B:
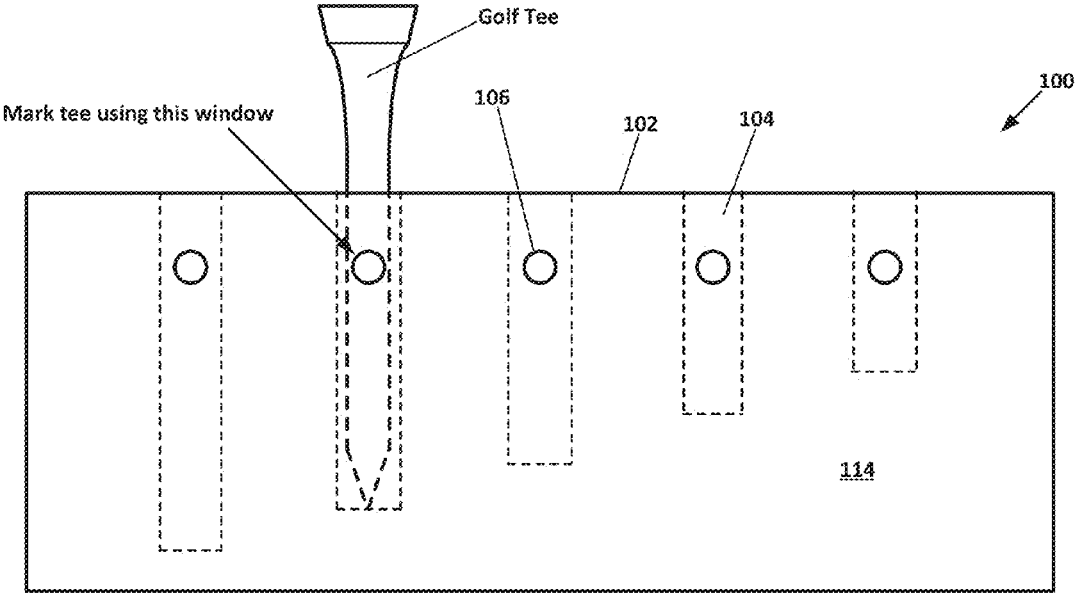
FIG. 9B illustrates a golf tee inserted into the golf tee insertion depth marking tool of FIG. 9A.

FIGS. 9A and 9B show one embodiment of a measurement tool 10 being used in conjunction with a depth marking device 100. In particular, the stem portion 14 of the marked measurement tool 10 may be inserted into one of the bores 104. Each bore 104 has a diameter sufficient to receive the shaft of a golf tee or the stem portion 14 of the depth measurement tool 10. Windows 106 are provided in a planar side surface 114 of the depth marker 100, each aligned with a corresponding one of the bores 104. As shown in FIG. 9A, after fully inserting the marked depth measurement tool 10 into a bore 104, the mark placed on the stem portion 14 of the measurement tool 10 will be visible through one of the windows 106. After the measurement tool 10 has been removed from the bore 104, an unmarked tee is placed into the same bore as shown in FIG. 9B. The tip of a marking pen may then be inserted into the corresponding window 106 to mark the tee.

In alternative embodiments of the measurement tool, such as depicted in FIGS. 1B and 1C, the stem portion 14 is pre-marked with indicator markings 22, such as horizontal lines (FIG. 1B) or numbers (FIG. 1C) or other markings, that correspond to the heights of the striking faces of various sizes of drivers and other golf clubs. In some embodiments, each indicator marking 22 is a different color from the others. Using these pre-marked embodiments of the tool 10, the golfer places the tool 10 next to the striking face of the club and takes note of which of the indicator markings 22 is most closely aligned with the height of the upper edge of the striking face. The tee is then marked at a location aligned with that indicator marking 22.

When used in association with the marking device 100 (FIGS. 9A-9B), after the pre-marked tool 10 is fully inserted the appropriate bore 104, the previously identified indicator marking 22 on the stem portion 14 of the tool 10 should be visible through the window 106 aligned with that bore 104, and that window 106 should be used for marking the tees as described previously.

Figure 7:
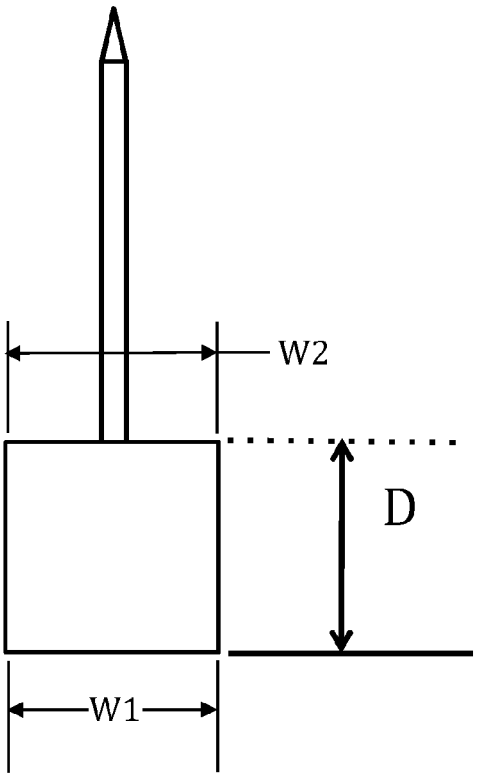
FIGS. 7 and 8 depict alternative embodiments of a golf tee insertion depth measurement tool, including embodiments having square and trapezoidal shaped base portions.
Figure 8:
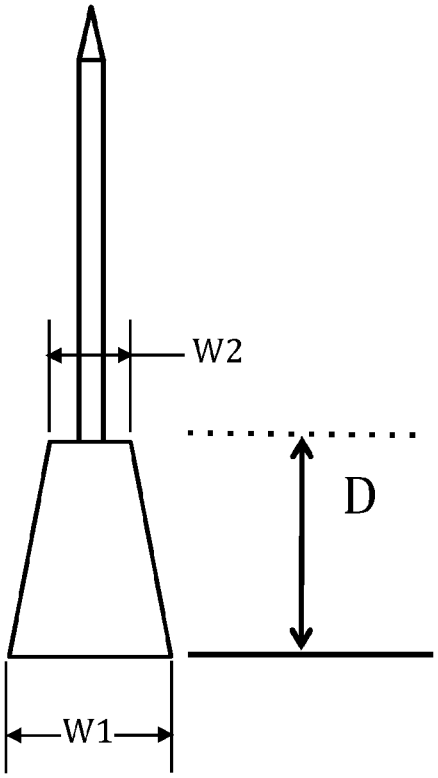

It will be understood that numerous modifications and substitutions can be made to the measurement tool 10 described above without departing form the spirit of the invention. For example, it should be appreciated that the base portion 12 may be formed in shapes other than circular or hemispherical, as long as its height D is maintained. For example, the base portion may square (FIG. 7) or trapezoidal (FIG. 8) in shape or other shapes.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A method of using a golf tee insertion depth measurement tool to mark a shaft of a golf tee to indicate a desired insertion depth which will provide an optimum height for a golf ball placed on a tee, which ball is to be struck by a club face having a height H, the method comprising the steps of:

(a) providing a golf tee insertion depth measurement tool having a base portion and an elongate stem portion having a stem length, wherein the base portion has at least a first surface that is substantially planar and a second surface spaced apart from the first surface by a first distance D and wherein the stem portion is connected to the base portion and extends outwardly away from the second surface of the base portion;

(b) providing a golf tee having a head, a shaft and a tip;

(c) placing the first surface of the base portion of the measurement tool on the ground surface;

(d) placing the golf club head on the ground surface with the striking face of the golf club adjacent the measurement tool;

(e) marking the stem portion of the measurement tool at a first location that is at a height above the ground surface equivalent to the height of an upper edge of the striking face of the golf club above the ground surface; and (f) marking the shaft of the golf tee at a location that is aligned with the mark made in step (e).

2. The method of claim 1 wherein step (f) comprises:

(f1) placing the head of the golf tee adjacent the second surface of the base portion such that the shaft of the tee extends along the stem portion to facilitate marking the shaft of the golf tee; and (f2) transferring the location marked on the stem portion directly to an equivalent location on the shaft of the tee.

3. The method of claim 1 wherein step (f) comprises:

(f1) providing a golf tee insertion depth marking device for marking the shaft of the golf tee, the device comprising:

a housing having at least a first surface and a second surface;

a plurality of bores extending from the first surface into the housing, each bore having a depth that is different from depths of other of the bores, each bore having a diameter sufficient to receive the shaft of the golf tee when the shaft is inserted therein; and a plurality of windows disposed in the second surface of the housing, each window providing an opening into a corresponding one of the bores, each window of sufficient size to receive a tip portion of a marking pen inserted therein, whereby the tip portion of the marking pen may make contact with and mark the shaft of the golf tee inserted into one of the bores;

(f2) inserting the marked stem portion of the measurement tool into an appropriate one of the plurality of bores to determine a window wherein the marked stem portion is visible through the opening of the window;

(f3) removing the stem portion from the appropriate bore;

(f4) inserting the golf tee into the appropriate bore; and (f5) marking the shaft of the golf tee by inserting the tip portion of a marking pen into the window determined in step (f2) and contacting the shaft of the golf tee.

* * * * *